United States Patent [19]

McGowan

[11] Patent Number: 4,476,770

[45] Date of Patent: Oct. 16, 1984

[54] DEVICE FOR MICRO TUNING PIANOS AND OTHER STRINGED INSTRUMENTS

[76] Inventor: Neil S. McGowan, 458 Rutherford Ave., Lyndhurst, N.J. 07071

[21] Appl. No.: 402,413

[22] Filed: Jul. 28, 1982

[51] Int. Cl.[3] ..... G10G 7/00; G10C 3/10

[52] U.S. Cl. ..... 84/458; 84/204

[58] Field of Search ..... 84/455, 458, 200, 201, 84/204, DIG. 18; 81/57.24, 57.26, 57.29

[56] References Cited

U.S. PATENT DOCUMENTS

| | | | |
|---|---|---|---|
| 360,409 | 4/1887 | Berner | 84/204 |
| 727,589 | 5/1903 | Clevenger et al. | 84/200 |
| 1,026,228 | 5/1912 | Severy et al. | 84/204 |
| 1,264,140 | 4/1918 | Bayer | 84/200 |
| 1,659,838 | 2/1928 | Schoeb | 81/57.26 |
| 2,254,012 | 8/1941 | Kudo | 84/455 |
| 2,603,976 | 7/1952 | Hilton | 81/57.29 |
| 2,917,961 | 12/1959 | Madonna | 84/204 |
| 3,777,611 | 12/1973 | Madonna | 84/204 |

FOREIGN PATENT DOCUMENTS

| | | | |
|---|---|---|---|
| 244236 | 3/1947 | Switzerland | 81/57.29 |

*Primary Examiner*—Donald A. Griffin

[57] ABSTRACT

A device for micro tuning stringed instruments such as pianos, harps, and the like including a portable tool mechanism removably attachable to a tuning peg having appropriate gearing and means for rotating the gearing to provide micro metric rotation of a socket adapted to be operatively disposed on an associated tuning peg, whereby rotation of the peg wraps the string associated therewith in a precise fashion.

9 Claims, 2 Drawing Figures

DEVICE FOR MICRO TUNING PIANOS AND OTHER STRINGED INSTRUMENTS

BACKGROUND OF THE INVENTION

This invention relates generally to a hand tool formulated to facilitate the precision tuning of pianos and other stringed instruments with a high degree of precision.

One of the problems associated with tuning stringed instruments such as pianos, and the like has been the tendency of the manipulative tool associated with the wire tensioning device to be mechanically so "fast" that over tensioning of the associated piano wire has occurred, and the wire has to thereafter be detensioned and subsequentially retensioned, an iterative process that is inefficient from a time and labor point of view, and therefore needlessly increases the tedium associated with the skilled tuning.

Known prior art devices exist in an attempt to address the above-noted problem, and the following patents reflect the state of the art of which applicant is aware, insofar as these patents appear to be germane to the process at hand.

| | | | |
|---|---|---|---|
| 360,409 | Berner | 2,917,961 | Madonna |
| 1,026,228 | Severy et al. | 3,777,611 | Madonna |
| 2,254,012 | Kudo | | |

Severy et al. teaches the use of a known prior art technique for tuning pianos and the like in which a winding drum (FIG. 3) is adapted to engage a tangent screw (FIG. 4) within a frame portion (FIG. 5) so that a piano wire 12 wound upon the drum can be adjusted by means of manipulating the screw as best shown in FIG. 1.

Similarly, each of the Madonna patents attempt to provide a solution to the long standing problem of precise micro metric tuning of piano strings wherein the peg upon which the piano wire is attached is provided by appropriate gearing to another mechanism the rotation of which operatively manipulates tension on the string.

The patent to Kudo teaches the use of a mechanical tuning device for stringed musical instruments utilizing a worm gear and an associated toothed wheel the interengagment of which provides the ability to rotate the toothed wheel 18 and therefore retension the strings.

The Berner piano tuning pin teaches a device somewhat similar to one of the Madonna patents, and is characterized in that a support block each has plural gearings thereon one for respective individual strings in a piano to be tuned.

All of the known prior art techniques discussed hereinabove share the common disadvantage that the complex gearing associated with micro tuning is integrally formed with the piano, raising the cost of an expensive instrument substantially. None of the devices discussed hereinabove exemplary of the prior art have ever met with a an appreciable degree of success in the marketplace because all of these mechanisms require retrofitting on existing pianos, or required that the piano manufacturer modify the instrument in accordance with the above disclosed tuning directives, an event which has not occurred presumably due to both the extraordinary increase in expense associated with the instrument and the problems with providing clearance within the piano for the plurality of mechanical linkages associated therewith.

By way of contrast, the instant invention is directed to and provides a single tool capable of selective deployment and removal from a conventional tuning peg on existing manufactured pianos which provides the micro metric tuning capabilities sought by the prior art devices but not obtainable thereby. The device according to the instant application can be rapidly and easily deployed from one peg to another, and is suitably configured and fashioned so as to decrease the likelihood of over tensioning a piano wire as conventional pianos are prone to do with the associated pegs, and provides advantages of the prior art in that a single mechanical linkage can be deployed from peg to peg removing the requirement of 88 separate gear assemblies and their associated clearance problems as would be required by the prior art.

SUMMARY AND OBJECTS OF THE INVENTION

Accordingly, this invention has as an objective the provision of a tool suitably formed to tune in a micro metric fashion pianos and other stringed instruments.

It is still a further object of this invention to provide a device of the character described above in which the mechanical gearing associated therewith affords extremely precise control over the tension imposed upon a piano wire or the like.

It is still a further object of this invention to provide a device of the character described above which can be readily disposed upon any of the plurality of tuning pegs on a piano without laborious and tedious initialization, a constraint inherent in the known prior art techniques.

It is still yet a further object of this invention to provide a device with the character described above in which a pluralilty of support means are selectively engagable with adjacent tuning pegs to provide a nesting and bearing surface for the tool thereby providing stability and enhancing the micro metric tuning ability of the instrument associated with the instant application.

It is still yet a further object of this invention to provide a device with the character described above which is extremely durable in construction and safe to use.

A further object of this invention contemplates the provision that the device as set forth hereinabove which would lend itself to mass production techniques.

These and other objects will be made manifest when considering the following detailed specification when taken in conjunction with the appended drawing figures wherein there is provided a device for micro tuning pianos, and other stringed instruments which includes a tuning peg receiving means, a shaft associated therewith and supported thereon a toothed wheel adapted to rotate said peg receiving means, a further gear operatively connected to said toothed gear to cause rotation thereof and of said peg receiving means, an instrumentality to rotate said further gear in operative meshing engagement with the toothed wheel, an instrumentality to reorient the rotational instrumentality about a specific set of axes while still allowing operative rotation of said further gear, and a nesting instrumentality associated operatively therewith adapted to find purchase areas and nest against other components associated with the piano, harps, zithers or other stringed instruments to provide a bearing surface for precise support of the micro metric tuning device.

BRIEF DESCRIPTION OF THE DRAWING FIGURES

BRIEF DESCRIPTION OF THE PREFERRED EMBODIMENT

Figure 1:
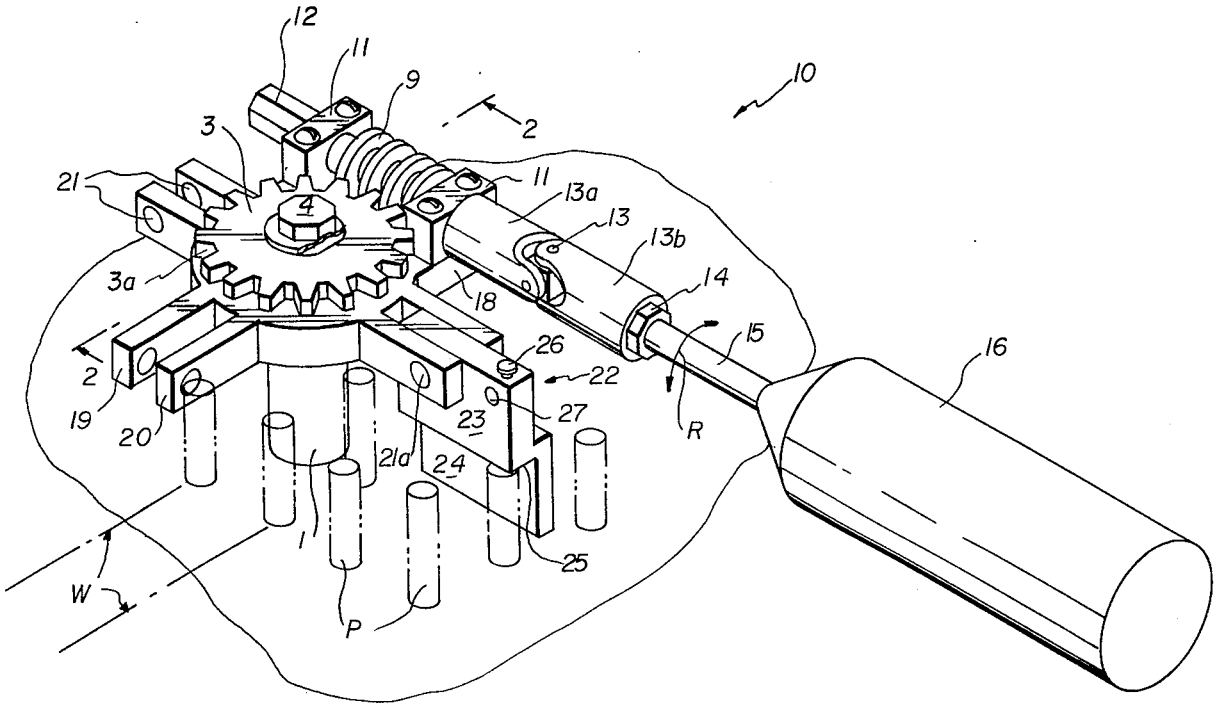
FIG. 1 is a perspective view of the apparatus according to the present invention in its associated environment.

Referring to the drawings now wherein like reference numerals refer to like parts throughout the various drawing figures, reference numeral 10 is directed to the micro tuning device for stringed instruments according to the instant application.

The tuning device 10 is formed with a depending socket member having an outer preferably annular wall 1 and a centrally disposed axially extending bore 2 provided with a configuration complemental to the outer surface of the piano tuning pegs p or any other peg as shown in FIG. 1. Since most of the pegs are quadralateral, a complementally formed foursided bore that engages the flat sides of the peg can securely and snuggly engage the peg, or in another alternative, an octagonal bore adapted to engage the mid points and the vertical edges of the peg head can also be provided. Other types of bores can be removably affixed to the tool 10 to accommodate different dimensioned tuning pegs. The upper end of the socket 1 is provided with a shoulder **1*b* from which extends a topmost portion 1*a* of the socket 1** having two opposed sides formed substantially planar and parallel to each other for purposes to be assigned shortly.

Figure 2:
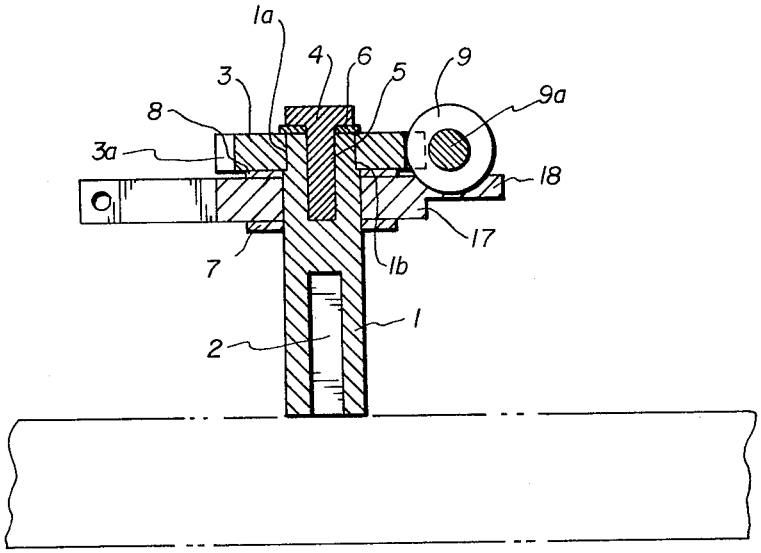
FIG. 2 is a sectional view taken along lines 2—2 of FIG. 1.

The socket 1 is supported on a body member 17 having a central opening dimensioned to receive the socket 1 as best shown in FIG. 2. The socket 1 is oriented appropriately within the body 17 by means of a stop shelf 7 disposed and fixed to the socket adjacent a lowermost portion of the body 17. On a top face of body 17, a spacer 8 is provided coplanar with the shoulder **1*b*. The topmost portion 1*a* of the socket 1 has an axially threaded bore 5 adapted to receive a screw 4 having complementally formed threads along its length. To this end, a spacer 6 is provided between the screw 4 and the socket body topmost portion 1*a* so that between the spacers 6 and 8 a toothed wheel 3 can be sandwiched. As shown, the wheel 3 has a plurality of radially disposed peripheral teeth 3*a* provided with a pitch complemental the pitch of a worm gear 9 supported on shaft 9*a***.

More specifically, the worm gear shaft **9*a* is carried by first and second spaced pillow blocks 11 each carried upon the body 17 by means of a laterally extending shelf 18 best viewed in FIG. 2. Thus, with the pillow blocks 11 bolted onto the supporting shelf 18, rotation of the worm gear 9 about the shaft 9*a* will cause incremental micro motion of the gear 3 through teeth 3*a* coacting with the worm gear 9. The spaced parallel flat sides on the upper body 1*a* and their mating interfit with associated flats on the toothed gear 3, along with the engagement of the screw 4, causes rotation of the socket 1 and its associated bore 2 and thus the micro adjustment of the tuning pegs 3** is possible.

Rotation of the shaft **9*a* of the worm gear 9 can occur in a most beneficial manner by virtue of the following mechanism. One end of the worm gear shaft 9*a* is provided with a cap 12 on a side of the pillow block 11 remote from the worm gear 9, and an opposed extremity of the shaft 9*a* remote from the cap 12 passes through the second of the two pillow blocks 11 and operatively communicates with a universal type joint 13 having a first portion 13*a* and a second portion 13*b* operatively affixed in an interconnecting gimble mechanism of substantially cruciform shape having extremities provided with bearings adapted to rotate within the first and second universal housing portions 13*a* and 13*b* respectively. Rotation of the shaft 9*a* is effected through the use of the universal joint mechanism by means of a handle 16 operatively connected to the second universal portion 13*b* by means of a shaft 15 extending between the universal 13*b* and the handle 16 and removably affixed thereto by a threaded member 14 so that removal of the handle 16** in favor of a different type of turning device (such as a rachet) is possible.

In use and operation therefore, the universal joint 13 allows orientation of its handle in a manner not axially aligned with the worm gear **9*a* so that obstructions and other impediments commonly found associated with and proximate to the plurality of tuning keys of the piano can be avoided and the tuning operation can proceed in a most expeditious fashion. The pitch of the worm gear 9 and its associated toothed gear 3 is such that relatively large rotation of the handle provides an extremely small micro metric rotation of the socket 1** an important consideration when tensioning the piano wire W.

An instrumentality is provided to lend and augment the stability of the tool in its associated and intended environment. More specifically three remaining quadrants removed from the shelf 18 (emanating radially from body member 17), are each provided with first and second horizontally extending pairs of ears 19 and 20, each having apertures 21 in linear alignment so that a bearing support plate 22 can be attached to one or more of the ear pairs as will now be defined. The bearing support plate 22 is formed from first and second vertically offset leg members 23 and 24 interconnected by a horizontal shelf 25 which all in a preferred form of the invention are integrally cast from a single piece. The shelf 25 provides a surface adapted to nest upon any of the plurality of tuning pegs P and the length of the lowermost leg 24 substantially corresponds to or is slightly less than the vertical dimension of the tuning peg so that at least one peg abuts a bottom face of the upper leg 23 (shelf 25) and is in tangential registry with the lowermost leg 24. By having the bearing plate 22 disposed between a pair of pegs for instance, stability and resistance to rotation of the tool will be effected, since the bearing plate 22 is connected at a topmost portion by means of a shaft **21*a* through the apertures 21 connected in the pair of ears 19, 20 as best seen in FIG. 1. Thus, the connecting pin 21*a* can be selectively removed and the bearing plate 22 can be repositioned in any of the three pairs of outwardly horizontally extending ears to take advantage of the location of the pegs used for support wherever they may happen to be. A pair of apertures 27 are provided at top corners of the upper leg 23 of the bearing plate 22 to support the shaft 21*a* therein. In a further preferred form, the bearing plate 22 includes a purchase area 26 in the form of a screw on an edge of upper leg 23 or the like which allows the bearing plate 22** to be kicked up when it is desired to move the tool from one peg to the next.

In use and operation, operative rotation of the handle and therefore the shaft 15 in the direction of the double arrows R cause rotation of the worm gear 9 and ultimately of the tooth gear 3 and therefore the socket 1. Due to the intimate contact of the socket 1 with the peg P rotation of the peg causes the piano wire W to be further wound thereabout, altering the tension of the piano wire. The relationship of the gearing provides precise control of the tuning process without needlessly overtensioning the piano wire.

Having thus described the invention it should be apparent that numerous structural modifications are contemplated at being part of this invention as set forth hereinabove and as defined within the scope and fair meaning of the claims appended hereto.

What is claimed is:

1. A device for micro tuning stringed instruments, comprising, in combination, socket means for removably receiving pegs of said instruments, bearing surface support means including a body having said socket means supported thereby, and rotating means disposed thereabove, and at least one pair of radially extending ears rotatably supporting a bearing support plate adapted to abut against and be constrained by pegs adjacent to the peg being tuned.

2. A device for micro tuning stringed instruments, comprising, in combination, socket means for removably receiving pegs of said instruments, bearing surface support means including a body having said socket means supported thereby, and rotating means disposed thereabove, and at least one pair of radially extending ears rotatably supporting a bearing support plate adapted to abut against and be constrained by pegs adjacent to the peg being tuned, and said body further includes a shelf portion emanating radially from said body and defining a second quadrant relative to said first pair of ears, said shelf serving to support thereon, first and second pillow blocks.

3. A device for micro tuning stringed instruments, comprising, in combination, socket means for removably receiving pegs of said instruments, bearing surface support means including a body having said socket means supported thereby, and rotating means disposed thereabove, and at least one pair of radially extending ears rotatably supporting a bearing support plate adapted to abut against and be constrained by pegs adjacent to the peg being tuned, and said pillow blocks support thereon, a worn gear shaft having a worn gear thereon, said body having disposed thereon, an overlying toothed gear in meshed registry with said worn gear, and means for rotating said worn gear to thereby rotate said toothed gear, said toothed gear operatively connected to said socket for simultaneous micro metric rotation.

4. A device for micro tuning stringed instruments, comprising, in combination, socket means for removably receiving pegs of said instruments, bearing surface support means including a body having said socket means supported thereby, and rotating means disposed thereabove, and at least one pair of radially extending ears rotatably supporting a bearing support plate adapted to abut against and be constrained by pegs adjacent to the peg being tuned, and said worn gear is operatively connected to a handle means for facile manipulation thereof.

5. A device for micro tuning stringed instruments, comprising, in combination, socket means for removably receiving pegs of said instruments, bearing surface support means including a body having said socket means supported thereby, and rotating means disposed thereabove, and at least one pair of radially extending ears rotatably supporting a bearing support plate adapted to abut against and be constrained by pegs adjacent to the peg being tuned, and said handle and said worn gear have interposed operatively therebetween, a universal joint means to allow angulation of said handle relative to said worn gear shaft to provide operative rotation thereof in the presence of impediments.

6. A device for micro tuning instruments, comprising, in combination, socket means for removably receiving pegs of said instruments, bearing surface means including a body having said socket means supported thereby, and rotating means disposed thereabove, and at least one pair of radially extending ears rotatably supporting a bearing support plate adapted to abut against and be constrained by pegs adjacent to the peg being tuned, and a second pair of ears emanating radially from said body, defining a third quadrant and adapted to receive said bearing plate thereon.

7. A device for micro tuning stringed instruments, comprising, in combination, socket means for removably receiving pegs of said instruments, bearing surface support means including a body having said socket means supported thereby, and rotating means disposed thereabove, and at least one pair of radially extending ears rotatably supporting a bearing support plate adapted to abut against and be constrained by pegs adjacent to the peg being tuned, and a third pair of ears disposed in a fourth quadrant emanating radially from said body, for like purposes.

8. A device for micro tuning stringed instruments, comprising, in combination, socket means for removably receiving pegs of said instruments, bearing surface support means including a body having said socket means supported thereby, and rotating means disposed above, and at least one pair of radially extending ears rotatably supporting a bearing support plate adapted to abut against and be constrained by pegs adjacent to the peg being tuned, and said bearing plate includes first and second legs vertically disposed and relatively off set to each other, and an interconnecting horizontal shelf therebetween, to serve as a purchase area for said pegs.

9. A device for micro tuning stringed instruments, comprising, in combination, socket means for removably receiving pegs of said instruments, bearing surface support means including a body for having said socket means supported thereby, and rotating means disposed thereabove, and at least one pair of radially extending ears rotatably supporting a bearing support plate adapted to abut against and be constrained by pegs adjacent to the peg being tuned, and said bearing plate includes a projection to facilitate retraction by rotation of said bearing plate about said pair of ears for removal of the tool from the associated environment.

* * * * *